United States Patent [19]

Sano

[11] 4,117,075

[45] Sep. 26, 1978

[54] METHOD OF COMBUSTION FOR DEPRESSING NITROGEN OXIDE DISCHARGE

[75] Inventor: Hiroshi Sano, Ikeda, Japan

[73] Assignee: Agency of Industrial Science & Technology, Tokyo, Japan

[21] Appl. No.: 495,429

[22] Filed: Aug. 7, 1974

[30] Foreign Application Priority Data

| | | | |
|---|---|---|---|
| Aug. 9, 1973 | [JP] | Japan | 48-89468 |
| Aug. 10, 1973 | [JP] | Japan | 48-90183 |
| Dec. 25, 1973 | [JP] | Japan | 48-1855 |

[51] Int. Cl.[2] ..... C01B 21/00

[52] U.S. Cl. ..... 423/235; 423/351; 431/2; 431/8

[58] Field of Search ..... 423/235, 351; 431/2, 431/5, 8; 23/277 C

[56] References Cited

U.S. PATENT DOCUMENTS

| | | | |
|---|---|---|---|
| 2,673,141 | 3/1954 | Barman | 423/235 |
| 3,370,914 | 2/1968 | Gross et al. | 423/351 |
| 3,729,285 | 4/1973 | Schwedersky | 431/8 |
| 3,779,014 | 12/1973 | Nohira et al. | 423/235 |
| 3,838,193 | 9/1974 | Kajitani et al. | 423/235 |
| 3,867,507 | 2/1975 | Myerson | 423/235 |
| 3,873,671 | 3/1975 | Reed et al. | 23/277 C |

*Primary Examiner*—O. R. Vertiz
*Assistant Examiner*—Eugene T. Wheelock
*Attorney, Agent, or Firm*—Oblon, Fisher, Spivak, McClelland & Maier

[57] ABSTRACT

In a combustion chamber, auxiliary combustion is effected by using carbon monoxide and/or hydrogen immediately after each charge of the main fuel has been burnt up therein. This method of combustion enables the nitrogen oxides resulting from the combustion of the main fuel to be reduced and brought to extinction by the auxiliary combustion, with the result that the nitrogen oxide content of the exhaust gas from the said combustion chamber is depressed.

5 Claims, 3 Drawing Figures

METHOD OF COMBUSTION FOR DEPRESSING NITROGEN OXIDE DISCHARGE

BACKGROUND OF THE INVENTION

This invention relates to a method of combustion for depressing the nitrogen oxide content of the exhaust gas discharging from a combustion chamber. More particularly the present invention relates to a method of combustion in a combustion chamber, which method comprises subjecting the nitrogen oxides (hereinafter referred to $NO_x$) occurring during the combustion of fuel to an additional combustion using hydrogen and/or carbon monoxide for thereby causing the nitrogen oxides to be reduced and brought to extinction and consequently depressing the escape of nitrogen oxides in the exhaust gas.

Of the techniques for controlling $NO_x$ discharge from the combustion chamber, the most widely known are the flue gas partial recirculation method and the two-stage combustion method. Because the occurrence of $NO_x$ is most intensified in the high-temperature oxidizing flame, these techniques are invariably directed to simultaneously lowering the concentration of oxygen which goes to form the flame and holding down the temperature of combustion. Since the high-temperature oxidizing flame enjoys the highest combustion efficiency, efforts to preclude the state of high-temperature oxidizing flame entail numerous disadvantages.

In the case of the flue gas recirculation method, for example, the stable state of combustion is sacrificed when the recycling ratio of the flue gas is increased for the purpose of providing enhanced depression of the $NO_x$ formation. In the case of the two-stage combustion method, the fuel fails to undergo complete combustion and gives off black smoke when the amount of air supplied relative to the fuel in the initial stage of combustion is decreased for the purpose of more rigidly controlling the occurrence of $NO_x$. Particularly when there is used coal or heavy oil which is quite productive of $NO_x$, the extent to which the amount of air supplied in the initial stage of combustion can be decreased is rather limited because of inferior combustion. Thus, this method cannot be expected to provide satisfactory depression of the $NO_x$ occurrence.

It is, therefore, an object of this invention to provide a method of combustion which provides effective depression of the occurrence of $NO_x$ while permitting the combustion to proceed efficiently in the form of high-temperature oxidizing flame.

SUMMARY OF THE INVENTION

To attain the object described above in accordance with this invention, there is provided a method of combustion whereby additional combustion is effected by using carbon monoxide and/or hydrogen immediately after the main fuel has been burnt up in the form of high-temperature oxidizing flame. The additional combustion given as described above causes the $NO_x$ occurring during the main combustion to be reduced and brought to extinction with the result that the $NO_x$ content of the exhaust gas from the combustion chamber is decreased. Further, since the main combustion is carried out in the form of high-temperature oxidizing flame, the fuel in use can be consumed with high efficiency.

DETAILED DESCRIPTION OF THE INVENTION

Figure 1:
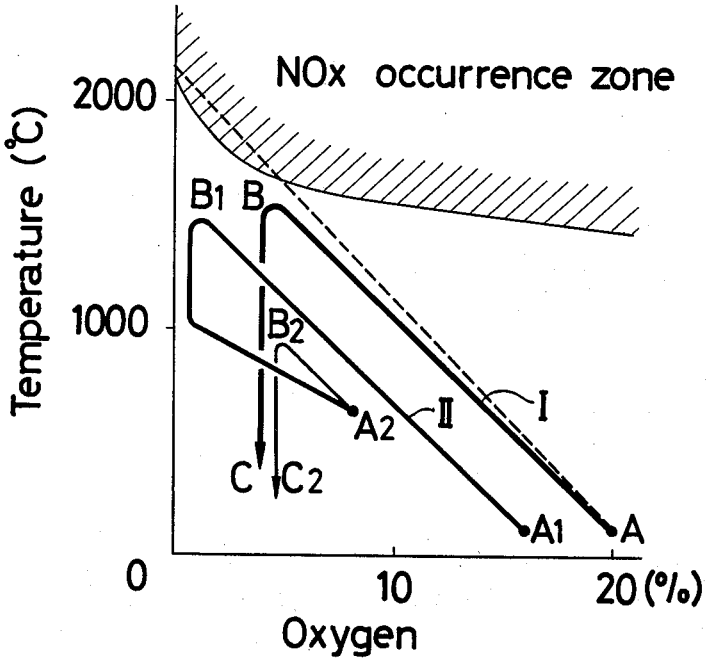
FIG. 1 is a graph comparing the state of combustion in the ordinary process of combustion with that in the known process of two-stage combustion.

With reference to FIG. 1, the upper area indicated by oblique lines represents a zone in which the atmosphere of combustion has high temperature and high oxygen concentration and involves heavy occurrence of $NO_x$. In the case of the ordinary combustion (Curve I), the combustion proceeds in the initial stage at a low temperature under a rich supply of oxygen (namely, at Point A). The combustion proceeds with gradually rising temperature and increasing consumption of oxygen. As the consumption of oxygen proceeds to reach the order of 4 to 5% of residual oxygen content, the combustion begins to occur in the form of high-temperature oxidizing flame (Point B). From this point on, the flame gradually declines in temperature through radiation of heat until it converts itself into waste gas (Point C). The combustion approaches the zone of heavy $NO_x$ occurrence when it is proceeding in the form of high-temperature oxidizing flame (namely, at Point B), indicating that the occurrence of $NO_x$ is unavoidable in the case of the ordinary combustion. In the case of the two-stage combustion (Curve II), the combustion starts under an insufficient supply of air relative to the fuel (Point $A_1$). When the temperature reaches its peak (Point $B_1$), the oxygen supply exhausts and the radiation of heat ensues. At this time, some of the fuel remains yet to be consumed. So, the second-stage supply of air is effected at this point (Point $A_2$). Consequently, the combustion is started again and allowed to proceed to the point (Point $B_2$). From this point on, the combustion proceeds with gradual liberation of heat and finally reaches the point of smoke discard (Point $C_2$). In other words, the two-stage combustion method manages to avoid approaching the zone of heavy $NO_x$ occurrence by incorporating a special process of the following mechanism.

$$\text{High-temperature reducing flame} \xrightarrow{\text{Supply of } O_2} \text{Medium-temperature oxidizing flame}$$

With the medium-temperature oxidizing flame, combustion of soot and other matter must proceed at a low temperature but the combustion temperature itself is so low that the velocity of combustion becomes slow. Accordingly, this can hardly be regarded as an effective means of combustion.

In view of the foregoing actual status of affairs, the inventor made research into a method of combustion which would depress the occurrence of $NO_x$ and at the same time allow the combustion to proceed constantly in the form of high-temperature oxidizing flame. He, consequently, made a discovery that the $NO_x$ content of the waste gas emanating from a combustion system can be decreased by introducing a specific fuel immediately after complete combustion has been effected on a charge of the main fuel in the form of high-temperature oxidizing flame for thereby reducing and bringing to extinction the $NO_x$ occurring in the discharging waste gas in consequence of the said combustion with the high-temperature oxidizing flame. This discovery was the starting point of the present invention.

Figure 2:
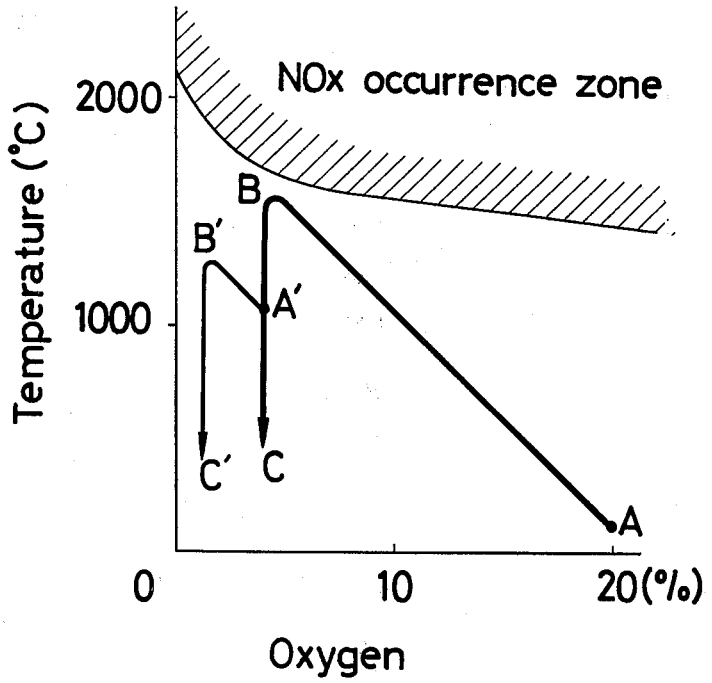
FIG. 2 is a graph illustrating the state of combustion in the process of combustion according to the present invention.

Now the method of combustion according to the present invention will be described herein below with reference to FIG. 2. In the initial stage, the combustion is made to proceed in much the same way as in the ordinary known method of combustion. For this purpose, a mixture of the fuel with such an amount of air as is enough to permit unobstructed combustion is supplied to the combustion chamber. Since there is a rich supply of oxygen in the first stage of combustion, the combustion starts from the conditions similar to those indicated by Point A of the graph of FIG. 1. With gradually increasing consumption of oxygen and continuous elevation of temperature, the combustion proceeds until there appears a high-temperature oxidizing flame (Point B). From this point on, the flame begins to radiate heat and decline in temperature. At this very point, a specific fuel is introduced to effect additional combustion (Point A'), with the result that the combustion regains its intensity and gains in temperature (Point B'). At this time, however, the combustion atmosphere is notably destitute of oxygen supply. Further, the specific fuel to be used for the purpose of additional combustion is carbon monoxide and/or hydrogen. As the result, the additional combustion proceeds not in the form of an oxidizing flame but in the form of a medium-temperature reducing flame. The medium-temperature reducing flame thus brought about by the additional combustion serves the purpose of reducing and bringing to extinction the $NO_x$ occurring during the combustion in the form of high-temperature oxidizing flame, causing the $NO_x$ content of the waste gas to be decreased. The process involved herein is expressed as follows.

$$\text{High-temperature oxidizing flame} \xrightarrow{CO \text{ or } H_2} \text{Medium-temperature reducing flame}$$

If the same fuel as the main fuel is used for the purpose of the additional combustion, then there naturally ensues incomplete combustion because the oxygen supply remains scarce. For this reason, the present invention uses as the fuel for the additional combustion, carbon monoxide and/or hydrogen which can be burnt up even at an extremely low oxygen concentration. By the incorporation of the process of such additional combustion into the process of the main combustion, the $NO_x$ which occurs during the main combustion is consumed in the form of combustion in conjunction with the residual oyxgen, so that the $NO_x$ content of the waste gas can be lowered.

As an $NO_x$ depressing technique similar in form to the present invention, there has heretofore been known a catalytic nonselective reducing method for denitrification using carbon monoxide or hydrogen. This method is directed at treating the flue gas which has already fulfilled its function by giving off heat. It reduces the $NO_x$ present in the smoke with carbon monoxide at a temperature in the neighborhood of 500° C, with copper oxide used as a catalyst. Generally, selective reaction is difficult to effect between $NO_x$ and residual oxygen. The whole residual oxygen is used up in this reaction. Accordingly, there is usually a temperature increase of 100° C for each 1% of oxygen consumed in the reaction. Thus, there is a possibility that because of such heavy heat loss, the catalyst bed will be inactivated by the intense heat. There is another possibility that the reaction will give rise to a toxic gas (COS) when the flue gas being treated contains any sulfur dioxide. In contrast, the method of the present invention is economical in that there occurs a reducing reaction at the flame, that the reaction velocity is so high as to preclude any necessity for increasing the dimensions of the combustion chamber and that the heat of reaction is wholly utilized as the combustion heat.

According to the present invention, the initial combustion is effected by the ordinary known method of combustion and complete combustion is accomplished by virtue of the high-temperature oxidizing flame. Normally, the air ratio and the concentration of formed $NO_x$ are about 1.5 and 800 ppm in the combustion of coal, about 1.3 and 500 ppm in the combustion of heavy oil and about 1.2 and 300 ppm in the combustion of propane gas respectively.

This initial combustion is followed by the incorporation of a fuel for the additional combustion. The temperature at which the additional combustion occurs is much lower than the critical temperature for $NO_x$ formation but is still higher than 1000° C. Therefore, the reaction of the oxygen and $NO_x$ present in the gas with carbon monoxide or hydrogen proceeds substantially nonselectively, causing the oxygen concentration in the gas to fall sharply and also the $NO_x$ concentration to decrease.

Now a description is given of the amount of the fuel for additional combustion to be blown into the combustion system.

When carbon monoxide is used as the fuel for additional combustion, the concentration of oxygen remaining in the burnt waste gas after sole combustion of the carbon monoxide gas can be lowered to the level of about 1% (corresponding to about 1.05 by air ratio). Therefore, it is most effective to regulate the amount of carbon monoxide to be blown in at such a level that the ratio of air to the whole fuel (initial fuel plus added carbon monoxide) falls in the neighborhood of 1.05. The $NO_x$ decreasing effect increases in proportion as the amount of introduced carbon monoxide increases over the air ratio of 1.05. The amount of $NO_x$, on the other hand, decreased in proportion as the amount of carbon monoxide introduced decreases from the air ratio of 1.05. In this case, however, the carbon monoxide begins to remain in an unconsumed form in the flue gas. It is, therefore, necessary that the amount of carbon monoxide for use in the additional combustion be selected proportionately to the amount of oxygen remaining after the first stage of combustion.

When hydrogen is used as the fuel for the additional combustion, the concentration of oxygen remaining in the burnt waste gas after sole combustion of the hydrogen gas can be lowered to the level of about 0.5% (corresponding to about 1.025 by air ratio). It is, therefore, most effective to regulate the amount of hydrogen to be blown in at such a level that the ratio of air to the whole fuel (initial fuel plus added hydrogen) falls in the neighborhood of 1.02. The $NO_x$ decreasing effect distinguishes in proportion as the amount of introduced hydrogen increases over the air ratio of 1.02. If the amount of the hydrogen introduced decreases from the air ratio of 1.02, the said effect increases proportionally but the hydrogen begins to reman in an unconsumed form in the waste gas. It is, therefore, necessary that the amount of hydrogen to be incorporated for the additional combustion be selected proportionately to the amount of oxygen remaining after the first stage of combustion.

The fuels, carbon monoxide and hydrogen, for the additional combustion may be used independently of each other. Alternatively, a water gas having the two fuels mixed at a suitable proportion may be used for the combustion.

The time at which the introduction of the fuel for the additional combustion is made can be fixed freely insofar as there are satisfied the requirements that the charge of the main fuel for first-stage combustion has already been burnt up and that the combustion atmosphere has not been cooled below the ignition point of the fuel for the additional combustion. As to the place of introduction of this fuel, it is desirable to have an inlet disposed in the upper section or near the outlet of the combustion chamber. Preferably an auxiliary combustion chamber may be properly installed so that the fuel will be received therein prior to supply to the main combustion chamber.

When the additional combustion is effected by using carbon monoxide and/or hydrogen as the fuel, there is produced the medium-temperature reducing flame which serves the purpose of reducing the $NO_x$ formed during the main combustion and consequently decreasing the $NO_x$ content of the waste gas.

Unlike any other known $NO_x$ depressing method, the method of the present invention requires no modification to the various conditions of main combustion such as air ratio, flame temperature, load during combustion and form of burner, for example. It can easily be effected by simply incorporating the process for additional combustion into the combustion system of the conventional operating principle and permits the amount of generated $NO_x$ to be decreased to the level substantially the same as that reached when carbon monoxide or hydrogen is burnt by itself.

A procedure by which the method of the present invention may desirably be carried out will be described below.

As concerns the occurrence of $NO_x$ during the combustion of fuel, it is generally known that under a fixed set of conditions, the ease with which $NO_x$ occurs decreases with the decreasing weight of fuel or decreasing size of carbon particles involved and that the degree of $NO_x$ occurrence decreases with the extent to which uniform combustion of fuel is obtained.

Fuels of the type which enjoy low $NO_x$ occurrence are generally expensive and therefore lack marketability and are not readily available. Thus it has been extremely difficult to replace all the fuels with low $NO_x$-producing fuels. As an expedient, there has been adopted a practice of having a low $NO_x$-producing fuel and a high $NO_x$-producing fuel burnt in burners disposed in parallel to each other (so as to be situated equally with reference to the flow of air for combustion). In this operation, the total amount of $NO_x$ generated is a simple average of the amounts of $NO_x$ to be produced when the two fuels are burnt independently of each other unless the flames of the two fuels induce appreciable mutual interference. Thus, the mixed combustion is not recognized to attain the intended effect of lowering $NO_x$ occurrence. When such two fuels are mixed in advance and the mixed fuel is burnt in one burner, the occurrence of $NO_x$ heavily varies so as to make difficult its accurate determination. Generally speaking, the overall $NO_x$ occurrence involved in this case is roughly equal to or slightly smaller than the average of the amounts of $NO_x$ produced when the two fuels are burnt separately.

In view of the actual state of affairs described above, the inventor pursued a further study after other methods of combustion capable of depressing $NO_x$ occurrence. He consequently discovered that in a combustion system in which a plurality of burners are disposed in a series connection relative to the direction of the flow of air introduced for combustion and a fuel of lower $NO_x$-producing property is supplied only to the last burner in the said series of burners, the $NO_x$ level is unexpectedly much closer to the $NO_x$ level of the fuel of lower $NO_x$-producing property than to the average of the $NO_x$ levels of the two fuels in use, permitting the amount of $NO_x$ released from the combustion system to be notably decreased. Thus, this method utilizes a combustion system having a plurality of burners disposed in a series connection relative to the direction of the flow of air for combustion, using in the last burner of the series a fuel having a lower $NO_x$-producing property than the fuel which is supplied to the preceding burners.

According to this method of combustion, the occurrence of $NO_x$ can be depressed to a remarkable extent and the burners in the latter part of the series can be used for independent combustion just like those in the former part of the series. When the combustion is effected with the burners in the latter part of the series alone, the air ratio particularly suited to such combustion can be obtained. Thus, this combustion has no possibility of causing incomplete combustion and is free from the influence of the air ratio for the burners in the former part of the series. In this combustion system, therefore, the amounts of fuels to be supplied can be varied with ample freedom.

For this method of the present invention, it is necessary that burners of the combustion system be arranged in a series connection relative to the direction of the flow of air introduced for combustion. The combustion systems to which this method is applicable include boilers, heating furnaces, incinerators, etc. The number of burners to be arranged in a series connection is not particularly limited insofar as there are used at least two burners. The space separating the adjacent burners is only required to be such that the luminous parts of the adjacent flames are prevented from overlapping each other. When the space separating the burners is so small as to permit the luminous parts of the adjacent flames to overlap each other, the effect of depressing the $NO_x$ occurrence is degraded to the level similar to that obtainable with the conventional mixed combustion involving use of burners disposed in parallel.

The preferred embodiment will be described with reference to FIG. 3. Within a combustion chamber 1, a front burner 3, a middle burner 4 and a last burner 5 are disposed in a series connection and air for combustion is caused to flow to a smoke duct 2 as indicated by the arrow mark. The last burner 5 and the immediately preceding middle burner 4 are separated by a space at least large enough for preventing the luminous parts of the flames at the two burners from overlapping each other.

In the present invention, it is necessary that additional combustion be effected by using in the last burner a fuel having a lower $NO_x$-producing property than the fuel used in the preceding burners. Generally, fuels when arranged in the decreasing order of $NO_x$-producing property, are ranked as follows:

Solid fuel (such as coal) > liquid fuel (such as petroleum) > gaseous fuel (such as town gas) Fuels of light unit weights and fuels less productive of carbon particles on thermal decomposition have low $NO_x$-producing properties. In the decreasing order of unit weight, liquid fuels are ranked as follows:

Heavy oil of Grade C > Heavy oil of Grade B > Heavy oil of Grade A > Light Oil > Kerosene > methanol Gaseous fuels, when arranged in the decreasing order of carbon formed by thermal decomposition, are ranked as follows:

LPG > methane > town gas (mixed gas of the order of 4000 to 5000 Kcal/$Nm^3$) > carbon monoxide > hydrogen The foregoing ranks of liquid fuels and gaseous fuels coincide with the ranks of the respective fuels arranged in the decreasing order of $NO_x$-producing property.

In the combustion system described above, when kerosene, methane, town gas, methanol, carbon monoxide or hydrogen is supplied so as to give substantially the same unit energy output (calories/hr) as that of heavy oil and the supply is made to a different burner, it is found that the supply of a low $NO_x$-producing fuel to the front burner has little effect in decreasing $NO_x$ occurrence and the same thing applies also to the middle burner. In contrast, when the supply of a low $NO_x$-producing fuel is made to the last burner, there is recognized a conspicuous effect in decreasing $NO_x$ occurrence. When fuels of gradually lower $NO_x$-producing properties are supplied to the preceding burners, the occurrence of $NO_x$ is observed to decrease as a consequence. The depression of $NO_x$ occurrence recognized in this case, however, is far smaller than when a fuel of high $NO_x$-producing property is used in general and a fuel of lower $NO_x$-producing property is used exclusively in the last burner.

According to the method of this invention, the $NO_x$ concentration which actually occurs is much smaller than the expected value which is calculated by load averaging, proportionately to the ratio of mixed combustion, the values of $NO_x$ actually measured by exclusive combustion of fuels involved (such as, for example, in the case of mixed combustion of two parts of heavy oil of Grade B and one part of hydrogen, the expected value is calculated as $(550 \times 2 + 20) \div 3 = 373$ ppm by using the respective values of $NO_x$, 550 ppm and 20 ppm, found during the exclusive combustions of the component fuels). When the low $NO_x$-producing fuel is used in other than the last burner, however; the actual $NO_x$ concentration invariably exceeds the expected value. When the amount of a lower $NO_x$-producing fuel to be supplied is greater than that of a high $NO_x$-producing fuel, the actual $NO_x$ concentration is only slightly smaller than the expected value and the $NO_x$ decreasing effect is about half the degree which is obtained where the lower $NO_x$-producing fuel is used exclusively in the last burner in an amount smaller than that of the high $NO_x$-producing fuel used in the other burners.

According to the present invention, the $NO_x$ discharge level obtained by the combustion mainly of an inexpensive high $NO_x$-producing fuel can easily be lowered to the level obtainable in the combustion exclusively of a low $NO_x$-producing fuel by incorporating an additional combustion using a small amount of an expensive low $NO_x$-producing fuel. This invention can be accomplished in such combustion system as a heating furnace or boiler which possesses a plurality of burners without requiring any major modification to the system and, for this reason, proves highly advantageous from the standpoint of prevention of environmental pollution.

Carbon monoxide or hydrogen has a much higher combustion velocity and a smaller ignition energy than hydrocarbon gases and, therefore, is most suitable for the purpose of the latter-stage combustion which is required to provide thorough combustion under such adverse conditions as low oxygen concentration, relatively low flame temperature and short duration. With this method, therefore, there is less possibility of misfire, the stability of the latter-stage combustion is high and the auxiliary combustion chamber can be decreased dimensionally to permit savings on the equipment cost. Moreover, any excess load of the fuel for the additional combustion neither endangers the operation nor causes discharging of black smoke.

Now, preferred embodiments of the present invention will be described herein below. It should be noted that the present invention is not limited to these examples.

EXAMPLE 1

Heavy oil of Grade B was supplied to a 1-$m^3$ combustion chamber at the rate of 20 liters/hour and burnt with a rotary burner, with the air ratio fixed at 1.3. At the outlet of the combustion chamber, carbon monoxide was supplied at a different blow volume indicated below and the exhaust smoke was tested for $NO_x$ content by the chemoluminescent method. The results were as shown in Table 1. In the table, the air ratio indicates the proportion relative to the total fuel (main fuel and fuel for additional combustion).

Table 1

| Amount of CO supplied ($Nm^3$/hr) | Air ratio | $NO_x$ content (ppm) |
|---|---|---|
| 0 | 1.3 | 500 |
| 16 | 1.1 | 220 |
| 20 | 1.05 | 120 |
| 22 | 1.08 | 75 |

It is clear from this table that in the absence of additional combustion, the $NO_x$ content of the flue gas was about 500 ppm but that in the presence of additional combustion of carbon monoxide at the rate of 22 $Nm^3$/hr, the $NO_x$ content of the flue gas fell to about 1/7.

EXAMPLE 2

Under entirely the same conditions as those of Example 1, heavy oil of Grade B was burnt and hydrogen in place of carbon monoxide was supplied as the fuel for additional combustion at a different flow volume indicated below at the outlet of the combustion chamber. The results were as shown in Table 2.

Table 2

| Amount of $H_2$ supplied ($Nm^3$/hr) | Air ratio | $NO_x$ content (ppm) |
|---|---|---|
| 0 | 1.3 | 500 |
| 16 | 1.1 | 210 |
| 22 | 1.08 | 70 |
| 23 | 1.02 | 40 |

It is clear from this table that when hydrogen was burnt at the rate of 23 $Nm^3$/hr for additional combustion, the $NO_x$ content of the flue gas was about 1/13 of the content which was found in the absence of additional combustion.

EXAMPLE 3

Under entirely the same conditions as those of Example 1, heavy oil of Grade B was burnt and a water gas (composed of 42% of carbon monoxide, 53% of hydrogen and 4% of carbon dioxide and nitrogen) was supplied as the fuel for additional combustion at a different flow volume indicated below at the outlet of the combustion chamber. The results were as shown in Table 3.

Table 3

| Amount of water gas supplied ($Nm^3/hr$) | Air ratio | $NO_x$ content (ppm) |
|---|---|---|
| 0 | 1.3 | 500 |
| 17 | 1.1 | 215 |
| 22 | 1.04 | 98 |
| 23 | 1.025 | 55 |

EXAMPLE 4

A powdered coal 5500 Kcal/kg in grade was supplied at the rate of 20 kg/hr, adjusted to an air ratio of 1.5 by Lodi-type pulverized coal burner and burnt in a combustion chamber 4 $m^3$ in inner volume. An auxiliary combustion chamber 0.5 $m^3$ in inner volume was installed at the outlet of the main combustion chamber and carbon monoxide was blown in at a different flow volume indicated below. The results were as shown in Table 4.

Table 4

| Amount of CO supplied ($Nm^3/hr$) | Air ratio | $NO_x$ content (ppm) |
|---|---|---|
| 0 | 1.5 | 800 |
| 15 | 1.1 | 280 |
| 17 | 1.05 | 150 |
| 18.5 | 1.08 | 80 |

Example 5

A powdered coal 5500 Kcal/kg in grade was supplied at the rate of 20 kg/hr, adjusted to an air ratio of 1.5 by a Lodi-tye pulverized coal burner and burnt in a combustion chamber 4 $m^3$ in inner volume. Ah auxiliary combustion chamber 0.3 $m^3$ in inner volume was installed at the outlet of the main combustion chamber and hydrogen was blown in at a different flow volume indicated below. The results were as shown in Table 5.

Table 5

| Amount of $H_2$ supplied ($Nm^3/hr$) | Air ratio | $NO_x$ content (ppm) |
|---|---|---|
| 0 | 1.5 | 800 |
| 15 | 1.1 | 250 |
| 18.5 | 1.03 | 75 |
| 19.2 | 1.02 | 40 |

Example 6

Propane gas was supplied to a gas burner at the rate of 10 kg/hr, adjusted to an air ratio of 1.2 by means of an internal mixing type burner (internal mixing ratio 40%) and burnt. A small baffleplate was installed at the outlet of the combustion chamber and carbon monoxide was blown in through behind the baffleplate. The results were as shown in Table 6.

Table 6

| Amount of CO supplied ($Nm^3/hr$) | Air ratio | $NO_x$ content (ppm) |
|---|---|---|
| 0 | 1.2 | 295 |
| 7.7 | 1.05 | 95 |
| 8.7 | 1.03 | 60 |

EXAMPLE 7

Under entirely the same conditions as those of Example 6, propane gas was burnt and hydrogen in place of carbon monoxide was blown in through behind the baffleplate installed at the outlet of the combustion chamber. The results were as shown in Table 7.

Table 7

| Amount of $H_2$ supplied ($Nm^3/hr$) | Air ratio | $NO_x$ content (ppm) |
|---|---|---|
| 0 | 1.2 | 295 |
| 8.7 | 1.03 | 55 |
| 9.2 | 1.02 | 35 |

EXAMPLE 8

Figure 3:
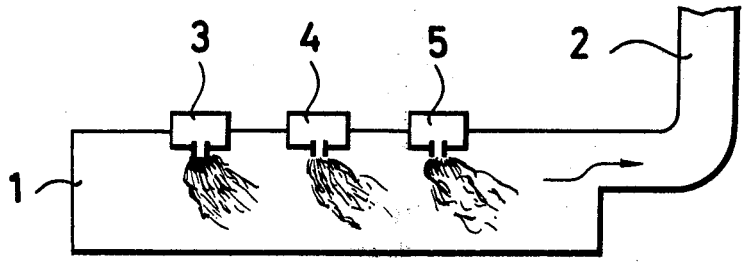
FIG. 3 is a longitudinal cross section illustrating one preferred embodiment of the combustion system for working the method of this invention.

Heavy oil of Grade B (10 lit/hr, with air ratio of 1.3), kerosene (12 lit/hr, with air ratio of 1.2), methane (11 $Nm^3/hr$, with air ratio of 1.15), town gas (5000 Kcal/$Nm^3$, 22 $Nm^3/hr$, with air ratio of 1.1), methanol (25 lit/hr, with air ratio of 1.1) and hydrogen (35 $Nm^3/hr$. with air ratio of 1.08) were supplied to and burnt at burners A, B and C in a combustion system of a construction like that shown in FIG. 3. For liquid fuels, the burners were of a low-pressure spray type. For gaseous fuels, the burners were of a dispersion combustion type. The flue gases discarding from different combination of fuels were tested for $NO_x$ concentration by the chemoluminescent method. The results are shown in Table 8.

Table 8

| Test No. | Fuel used: Front burner | Middle burner | Last burner | $NO_x$ concentration (ppm) |
|---|---|---|---|---|
| 1-1 | Grade B | Grade B | Grade B | 550 |
| 1-2 | Grade B | Grade B | Kerosene | 320 |
| 1-3 | Grade B | Grade B | Methane | 300 |
| 1-4 | Grade B | Grade B | Town gas | 210 |
| 1-5 | Grade B | Grade B | Methanol | 150 |
| 1-6 | Grade B | Grade B | Hydrogen | 80 |
| 1-7 | Grade B | Kerosene | Grade B | 500 |
| 1-8 | Grade B | Methane | Grade B | 470 |
| 1-9 | Grade B | Town gas | Grade B | 450 |
| 1-10 | Grade B | Methanol | Grade B | 410 |
| 1-11 | Grade B | Hydrogen | Grade B | 400 |
| 1-12 | Kerosene | Grade B | Grade B | 540 |
| 1-13 | Methane | Grade B | Grade B | 540 |
| 1-14 | Town gas | Grade B | Grade B | 520 |
| 1-15 | Methanol | Grade B | Grade B | 520 |
| 1-16 | Hydrogen | Grade B | Grade B | 500 |

EXAMPLE 9

The procedure of Example 8 was repeated by using the same fuels, the same combustion conditions and the same method of determination, except for variation in the proportions of component fuels supplied for mixed combustions, to determine $NO_x$ contents on the flue gas discharged. The results are shown in Table 9.

Table 9

| Test | Fuel used: Front | Middle | Last | $NO_x$ concentration (ppm): Expected |
|---|---|---|---|---|

Table 9-continued

| No. | burner | burner | burner | Found (a) | value (b) | (a) − (b) |
|---|---|---|---|---|---|---|
| 2-1 | Grade B | Grade B | Grade B | 550 | — | — |
| 2-2 | Grade B | Grade B | Kerosene | 320 | 440 | −120 |
| 2-3 | Grade B | Kerosene | Kerosene | 270 | 330 | −60 |
| 2-4 | Kerosene | Kerosene | Kerosene | 220 | — | — |
| 2-5 | Grade B | Grade B | Methane | 300 | 433 | −133 |
| 2-6 | Grade B | Methane | Methane | 250 | 316 | −66 |
| 2-7 | Methane | Methane | Methane | 200 | — | — |
| 2-8 | Grade B | Grade B | Town gas | 210 | 410 | −200 |
| 2-9 | Grade B | Town gas | Town gas | 180 | 270 | −90 |
| 2-10 | Town gas | Town gas | Town gas | 130 | — | — |
| 2-11 | Grade B | Grade B | Methanol | 150 | 383 | −233 |
| 2-12 | Grade B | Methanol | Methanol | 80 | 216 | −136 |
| 2-13 | Methanol | Methanol | Methanol | 50 | — | — |
| 2-14 | Grade B | Grade B | Hydrogen | 80 | 373 | −296 |
| 2-15 | Grade B | Hydrogen | Hydrogen | 50 | 196 | −146 |
| 2-16 | Hydrogen | Hydrogen | Hydrogen | 20 | — | — |

EXAMPLE 10

The procedure of Example 8 was repeated by using the same fuels, the same combustion conditions and the same method of determination, except that the last burner was shut off and the front burner and the middle burner were operated for combustion. The results are shown in Table 10.

Table 10

| Test No. | Fuel used: Front burner | Fuel used: Middle burner | $NO_x$ concentration (ppm) |
|---|---|---|---|
| 3-1 | Grade B | Grade B | 480 |
| 3-2 | Grade B | Methane | 190 |
| 3-3 | Methane | Methane | 180 |
| 3-4 | Grade B | Hydrogen | 50 |
| 3-5 | Hydrogen | Hydrogen | 20 |

What is claimed is:

1. A method for decreasing the discharge of nitrogen oxides by combustion in a medium temperature reducing flame atmosphere comprising the steps of:

(1) producing a high temperature oxidizing flame by combustion of a first fuel with an amount of air in excess of the theoretical amount required for complete combustion of said fuel wherein said combustion produces combustion products containing nitrogen oxides;

(2) admixing the combustion products containing nitrogen oxides with a second fuel selected from the group consisting of carbon monoxide, hydrogen or mixtures thereof at a temperature higher than 1000° C but lower than the critical temperature for the formation of nitrogen oxides, wherein the air to first fuel plus second fuel ratio is maintained greater than that necessary to completely combust said first fuel plus said second fuel and wherein the concentration of oxygen in the resulting waste gas is less than 1%, whereby additional combustion occurs forming a medium-temperature reducing flame atmosphere and decreasing the nitrogen oxides content of said waste gas; and (3) discharging the resulting waste gas.

2. The method of claim 1 wherein the fuel for the additional combustion is a water gas.

3. A method of combustion for depressing discharge of nitrogen oxides, which comprises utilizing a combustion/system wherein a plurality of burners are disposed in a series connection relative to the direction of the flow of air introduced for combustion and using in the last one of the said series of burners a fuel of a lower $NO_x$-producing property than the fuel used for the preceding burners.

4. A method of claim 3, the fuel for the last burner is carbon monoxide.

5. A method of claim 3, the fuel for the last burner is hydrogen.

* * * * *